US005404122A

United States Patent [19]

Maeda et al.

[11] Patent Number: 5,404,122

[45] Date of Patent: Apr. 4, 1995

[54] SUPERCONDUCTING COIL APPARATUS WITH A QUENCHING PREVENTION MEANS

[75] Inventors: Hideaki Maeda; Masami Urata, both of Yokohama; Katsumi Kurosawa, Kawaguchi; Shoji Matsuda, Hachiooji, all of Japan

[73] Assignee: Kabushiki Kaisha Toshiba, Kawasaki, Japan

[21] Appl. No.: 489,100

[22] Filed: Mar. 6, 1990

[30] Foreign Application Priority Data

Mar. 8, 1989 [JP] Japan ..... 1-55897

[51] Int. Cl.[6] ..... H01F 7/22

[52] U.S. Cl. ..... 335/216; 335/300; 505/879

[58] Field of Search ..... 335/216, 299, 300; 505/705, 879, 885, 902, 903, 904, 924, 926; 104/281, 283, 284; 361/19

[56] References Cited

U.S. PATENT DOCUMENTS

| | | | |
|---|---|---|---|
| 3,474,294 | 10/1969 | Weaver | 361/19 |
| 3,611,078 | 10/1971 | Massar | 361/19 |
| 3,768,417 | 10/1973 | Thornton et al. | 104/284 |
| 4,140,021 | 2/1979 | Nomura | 361/19 |
| 4,349,853 | 9/1982 | Sato | 361/19 |
| 4,808,954 | 2/1989 | Ito | 335/216 |
| 4,812,796 | 3/1989 | Reis | 335/216 |

FOREIGN PATENT DOCUMENTS

| | | |
|---|---|---|
| 2011570 | 9/1970 | Australia . |
| 076887 | 8/1982 | European Pat. Off. . |
| 63-70505 | 3/1988 | Japan . |
| 2155243 | 2/1985 | United Kingdom . |

OTHER PUBLICATIONS

Chapter VI, Sec. 62, "Solenoid Magnet Design", Robert E. Krieger Publishing Company, by D. B. Montgomery and R. J. Weggel (1969).

Patent Abstracts of Japan vol. 11, No. 143 (E-504) (2590) 09 May 1987, & JP-A-61 281504 (Sumitomo Electric Ind. Ltd.) *The Whole Document*.

Patent Abstracts of Japan vol. 6, No. 119 (E-116) (997) 03 Jul. 1982, & JP-A-57 48203 (Tokyo Shibaura Denki K.K.) *The Whole Document*.

Patent Abstracts of Japan vol. 12, No. 99 (E-594) (2946) 31 Mar. 1988, & JP-A-62- 229905 (Toshiba Corp) *The Whole Document*.

Patent Abstracts of Japan vol. 10, No. 302 (E-445) (2358) 15 Oct. 1986, & JP-A-61 115309 (Toshiba Corp.) *The Whole Document*.

Patent Abstracts of Japan vol. 12, No. 174 (E-612) (3021) 24 May 1988, & JP-A-62 283604 (Toshiba Corp.) *The Whole Document*.

Patent Abstracts of Japan vol. 11, No. 127 (E-501) (2574) 21 Apr. 1987, & JP-A-61 271804 (Toshiba Corp.) *The Whole Document*.

*Primary Examiner*—Leo P. Picard
*Assistant Examiner*—Trinidad Korka
*Attorney, Agent, or Firm*—Oblon, Spivak, McClelland, Maier & Neustadt

[57] ABSTRACT

A superconducting apparatus is provided with windings having superconducting wires wound in a plurality of turns, and a cryostat housing the windings so as to cool the windings in a superconducting state. The superconducting wires disposed at the outer and inner peripheral areas of the windings are selected to be highly stabilized superconducting wires such that, even if frictional heat is conducted towards the windings, the highly stabilized superconducting wires are very less quenched and in turn the possibility of the quenching of the overall windings is extremely low. Further, good heat conductors are provided on the radially outer and inner of the windings. Frictional heat which flows towards the windings is transmitted into the good heat conductors in the circumferential direction, and is dissipated midway during the heat conduction. As a result, the introduction of the frictional heat into the windings is avoided and in consequence no quenching occurs in the superconducting wires. This enables the overall windings to be prevented from being quenched.

12 Claims, 8 Drawing Sheets

SUPERCONDUCTING COIL APPARATUS WITH A QUENCHING PREVENTION MEANS

BACKGROUND OF THE INVENTION

1. Field of the Invention

This invention relates to a superconducting coil apparatus, and more particularly, to a superconducting coil apparatus used in the linear motor of a magnetic floating train, the propelling motor of a electromagnetic propelling ship and the like.

2. Description of the Related Art

A racetrack type superconducting coil apparatus, as an example of a superconducting coil apparatus, is provided with windings formed from superconducting wires wound in a racetrack form and firmly fixed to each other by epoxy resin, and a cryostat containing the windings and so formed in a racetrack shape as to correspond to the shape of the windings. The outer and inner peripheral walls of the cryostat are disposed on the radially outer and inner of the windings. Liquid helium passages are defined between the outer and inner peripheral walls of the cryostat and the windings. When the windings are cooled lower than the transition temperature, their state is changed from the normal-conducting state to the superconducting state. Upon exciting the windings in the latter state, a high-intensity magnetic field is generated from the windings without any electrical loss.

While the windings are being excited, hoop stresses which are large magnetic forces are applied to the windings in the radial directions. If the windings are deformed so as to tend to assume a true circle form, it is likely that the superconducting wires are quenched and their state tends to be changed to the normal-conducting state. In order to avoid this, the windings are fixed to the outer and inner peripheral walls of the cryostat by means of a plurality of fixtures placed between the windings and the outer and inner peripheral walls of the cryostat (that is, in the liquid helium passages). The fixtures have holes for passing liquid helium. The opposed inner peripheral wall portions of the cryostat are connected to each other by means of reinforcing members. This structure prevents the most degree of deformation of the windings.

However, not so many fixtures can be arranged in the liquid helium passages because the arrangement of many fixtures lowers the cooling efficiency of the winding unit. This arrangement cannot fully hinder the windings from being deformed and thus it is possible that the windings change their shape slightly. The deformation of the windings causes rubbing between the fixtures and the windings to generate frictional heat. Although part of the frictional heat is absorbed by the liquid helium, the remainder of it is transferred to the superconducting wires in the outer and inner peripheral areas of the windings and quenches them. As a result, the superconducting wires of the overall windings are frequently quenched.

SUMMARY OF THE INVENTION

The object of this invention is to provide a superconducting coil apparatus in which the superconducting wires of the windings are prevented from being quenched by heat conducted in the windings such that the excitation can be carried out in a stable state.

According to the present invention, there is provided a superconducting coil apparatus, comprising:

- windings having superconducting wires wound in a plurality of turns;
- means for fixing the adjacent superconducting wires together;
- a cryostat housing the windings, for cooling the same in a superconducting state;
- means for mounting the windings in the cryostat; and
- means for preventing the superconducting wires of the windings from quenching, which is caused by heat conducted in the windings.

The quench preventing means includes highly stabilized superconducting wires which are part of the superconducting wires of the windings and arranged outer and inner peripheral areas of the windings. If, therefore, frictional heat is conducted in the windings, it is less possible that the highly stabilized superconducting wires are quenched, and consequently there is few possibility that the overall windings are quenched. As a result, the superconducting coil apparatus is excited in a stable state.

Further, the quench preventing means includes good heat conductors arranged on the radially outer and inner of the windings. The frictional heat, as it is conducted in the windings, is transmitted to the good heat conductors in the circumferential directions of the windings, and is dissipated midway during the conduction. Therefore, the friction heat is prevented from being conducted in the windings, and the superconducting wires at the outermost and innermost areas of the windings are free from quenching. This follows that the overall windings are kept from being quenched.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
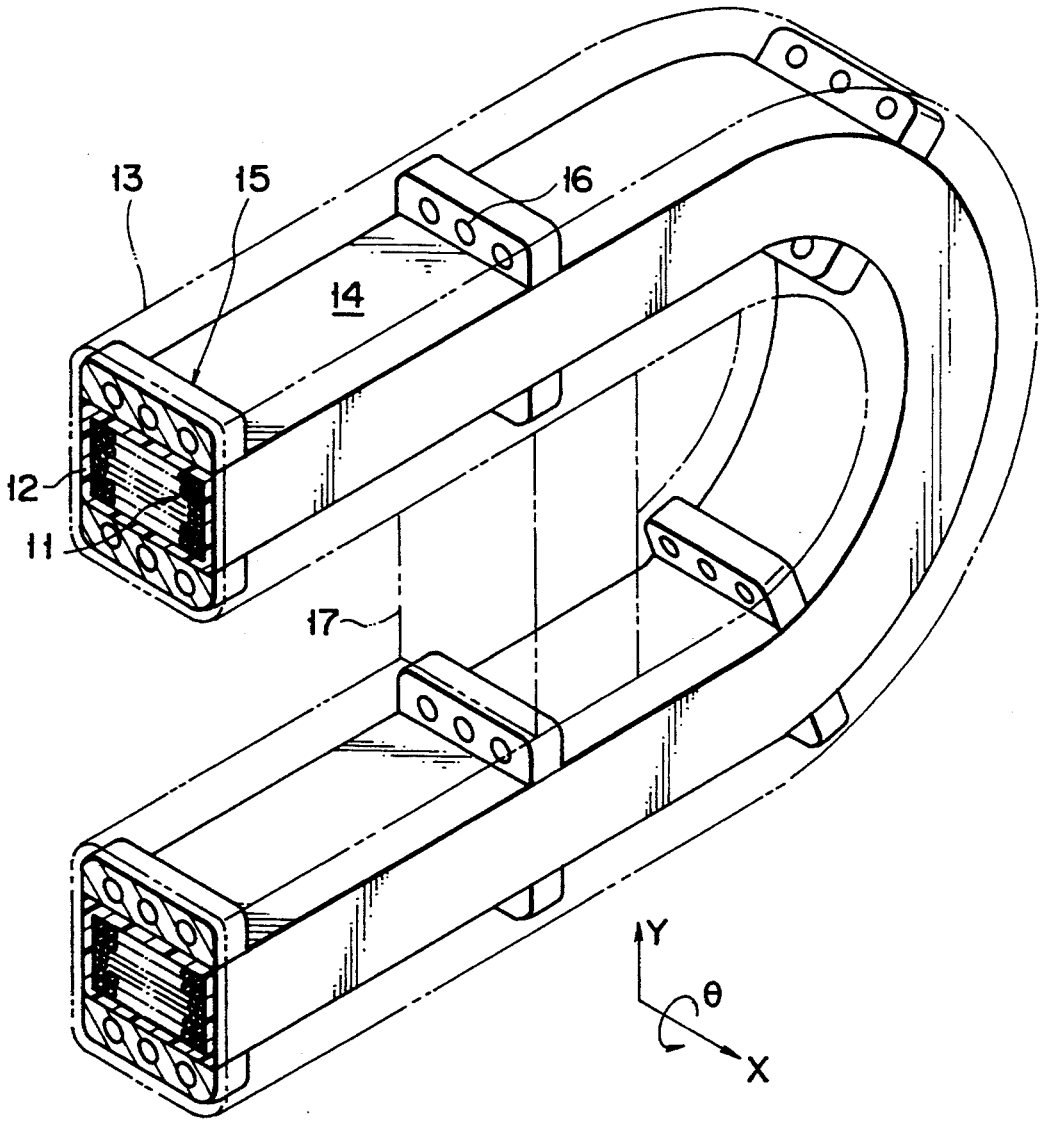
FIG. 1 is a perspective view of a part of a superconducting coil apparatus according to one embodiment of the present invention.

FIG. 1 shows a superconducting coil apparatus according to the first embodiment of the present invention. Windings 11 of the coil apparatus comprise superconducting wires wound in a racetrack form. Each superconducting wire is a multi-core compound wire made of a superconductor such as Nb-Ti, and a copper matrix (or a stabilizer) surrounding the superconductor. Throughout this specification, as shown in FIG. 1, the directions indicated by arrows X, Y and $\theta$ are defined as axial, radial and circumferential directions of the windings 11, respectively.

Curing type resin in a soft state (for example, epoxy resin) is filled in the spaces between the adjacent superconducting wires of the windings 11, and then is cured such that the adjacent superconducting wires are firmly fixed to each other. The resin is also applied to cover the windings 11 and, after cured, it forms a cured resin layer 12 around the windings 11.

The windings 11 are housed in a cryostat 13 formed in a racetrack shape corresponding thereto. Between the outer wall of the cryostat 13 and the cured resin layer 12 is defined a fluid passage 14 for flowing a coolant (for example, liquid helium). When the liquid helium flows in the fluid passage 14 and thereby the winding unit 11 is cooled under the transition temperature, the state of the windings 11 changes into and remains in the superconducting state.

Figure 2:
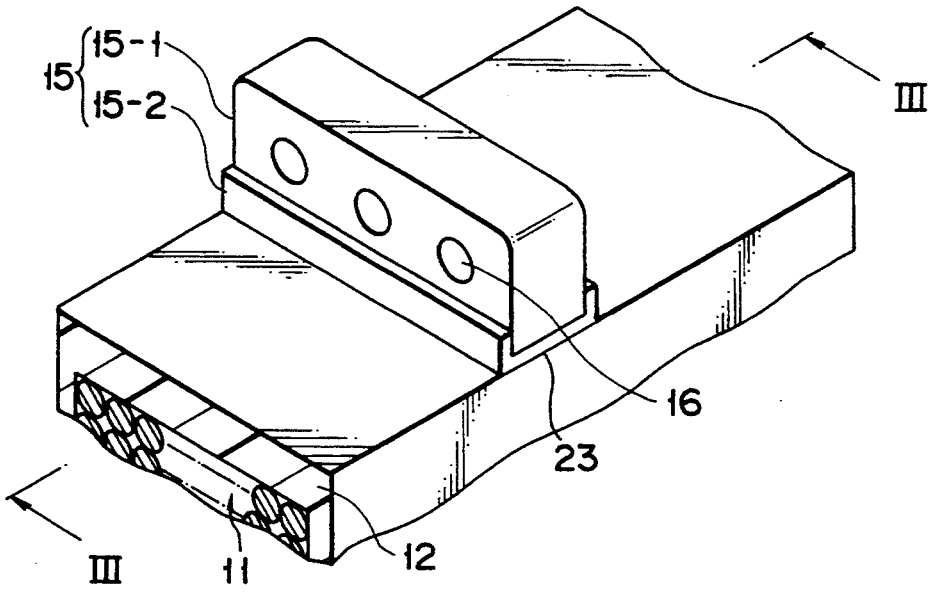
FIG. 2 is an enlarged perspective view of part of the superconducting apparatus as shown in FIG. 1.
Figure 3:
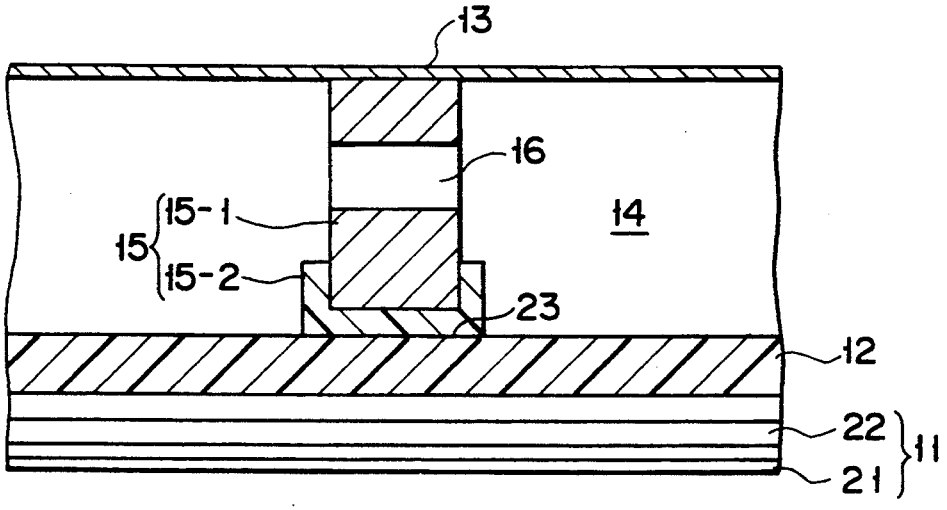
FIG. 3 is a cross-sectional view along line III—III of FIG. 2.

A plurality of fixtures 15 are placed between the radially outer and inner wall of the cryostat 13 and the cured resin layer 12 on the outer periphery of the windings 11, in such a manner that the windings 11 are fixedly mounted in the cryostat 13. As shown in FIGS. 2 and 3, each fixture 15 comprises a first portion 15-1 made of stainless steel having a high specific heat, and a second portion 15-2 made of FRP and disposed between the first portion 15-1 and the cured resin layer 12 of the windings 11. In the first portion 15-1 are formed with holes 16 for passing liquid helium. As shown in FIG. 1, the opposed portions of the inner wall of the cryostat 13 are bridged to each other by reinforcing members 17 to prevent the radial deformation of the windings 11.

Figure 4:
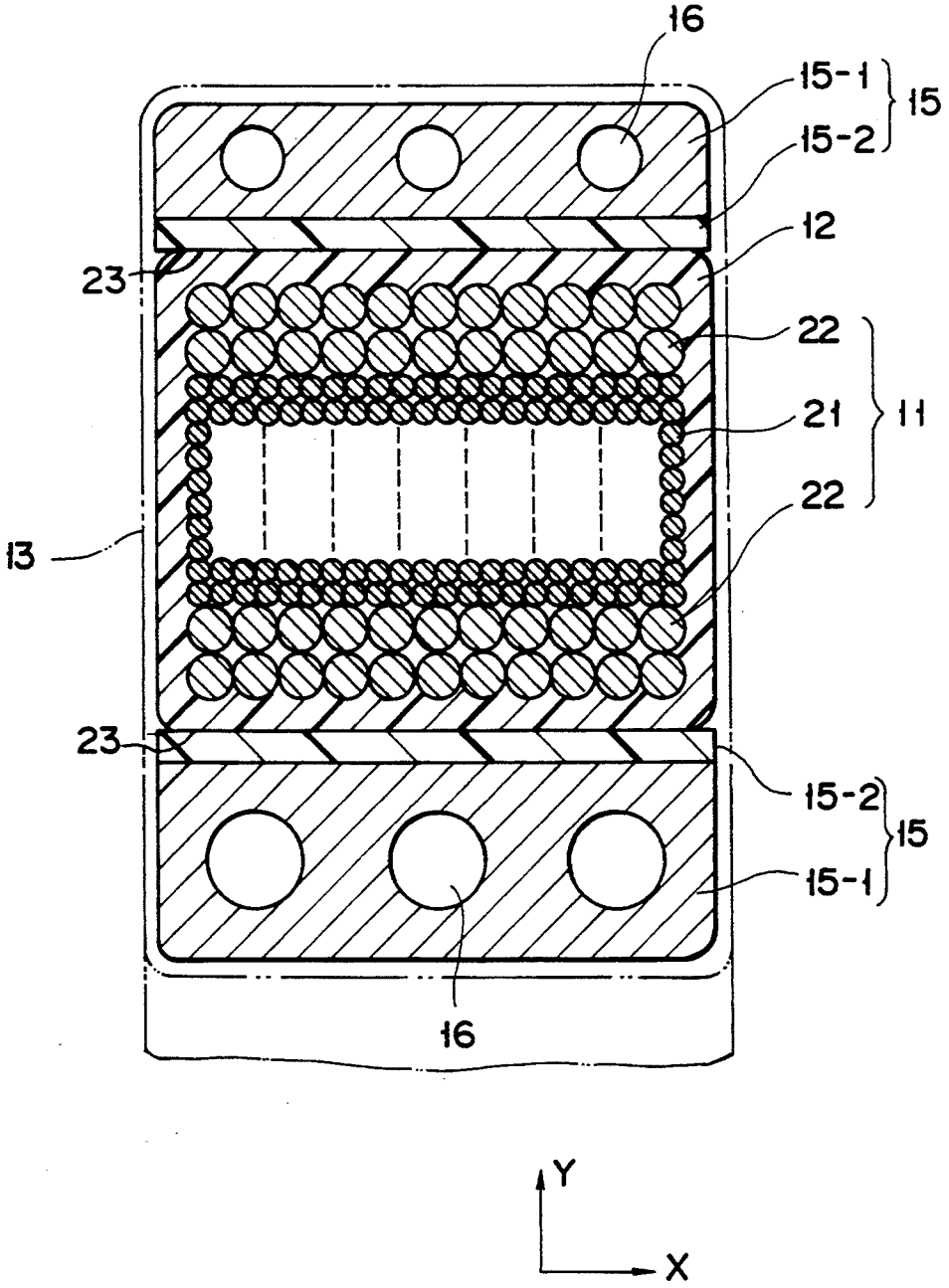
FIG. 4 is a cross-sectional view of the superconducting coil apparatus of FIG. 1.

As best shown in FIG. 4, the windings 11 of the first embodiment comprises intermediate layers consisting of an ordinary superconducting wire 21, and two outer peripheral layers and two inner peripheral layers consisting of highly stabilized superconducting wires 22 which are hard to be quenched. The ordinary superconducting wire 21 and the highly stabilized superconducting wires 22 are connected together by soldering or the like, and then they are wound and arranged in the above-mentioned manner.

The highly stabilized superconducting wire 22 is one selected, for example, from:

(1) a superconducting wire having a diameter larger than that of the ordinary superconducting wire;

(2) a superconducting wire having a higher copper ratio;

(3) a superconducting wire having a large cross-sectional area of a superconducting portion; and (4) a superconducting wire formed by a superconductor made of a chemical compound $NB_3Sn$ or $V_3Ga$, both the compounds having relatively high transition temperatures.

Alternatively, the highly stabilized superconducting wire 22 can consist of at least two of the above-specified four wires.

The superconducting coil apparatus is provided with the fixtures 15 and the reinforcing members 17 for preventing the deformation of the winding unit 11 due to the hoop stresses. Since, however, the fixtures 15 are arranged at predetermined intervals in the circumferential direction of the windings 11, overall outer peripheral portions of the windings 11 are not completely fixed to the cryostat 13, with the result that the deformation of the winding unit 11 are not fully eliminated. As the winding unit 11 is deformed by the hoop stresses, therefore, frictional heat is generated at the boundary 23 between the cured resin layer 12 of the winding unit 11 and the second portion 15-2 of each fixture 15. Part of the frictional heat is absorbed by the liquid helium but the remainder thereof tends to be transmitted to the windings 11. In particular, there is a high possibility that the frictional force generated at the central part of the boundary 23 is conducted to the windings 11.

When the superconducting wires disposed in the outer and inner peripheral areas of the windings are quenched in the conventional apparatus, the overall windings are frequently quenched.

The two layers of the outer peripheral area and the two layers of the inner peripheral areas of the winding unit 11 of the first embodiment of the present invention are formed by highly stabilized superconducting wires 22. Thus, even if the frictional heat is transmitted towards the winding unit 11, the highly stabilized superconducting wires 22 are rarely quenched by the frictional heat. Consequently there is few possibility that overall windings are quenched. Thus, the superconducting coil is excited in a stable state.

The inventors of the present invention made experiments by exciting a superconducting coil apparatus according to the first embodiment of the present invention. The experimental results showed that the quenching current (that is, a current value at which the quenching takes place) for the apparatus according to the first embodiment of the present invention was extremely larger than that for the conventional apparatus and, therefore, the apparatus according to the first embodiment could be excited extremely more stably than the conventional apparatus.

With the first embodiment, the two layers of the outer peripheral area and the two layers of the inner peripheral area of the windings 11 are formed by the highly stabilized superconducting wires 22. It is sufficient, however, the layers of the proximity of the outer and inner peripheral areas of the windings 11 are formed by highly stabilized superconducting wires 22.

Figure 5:
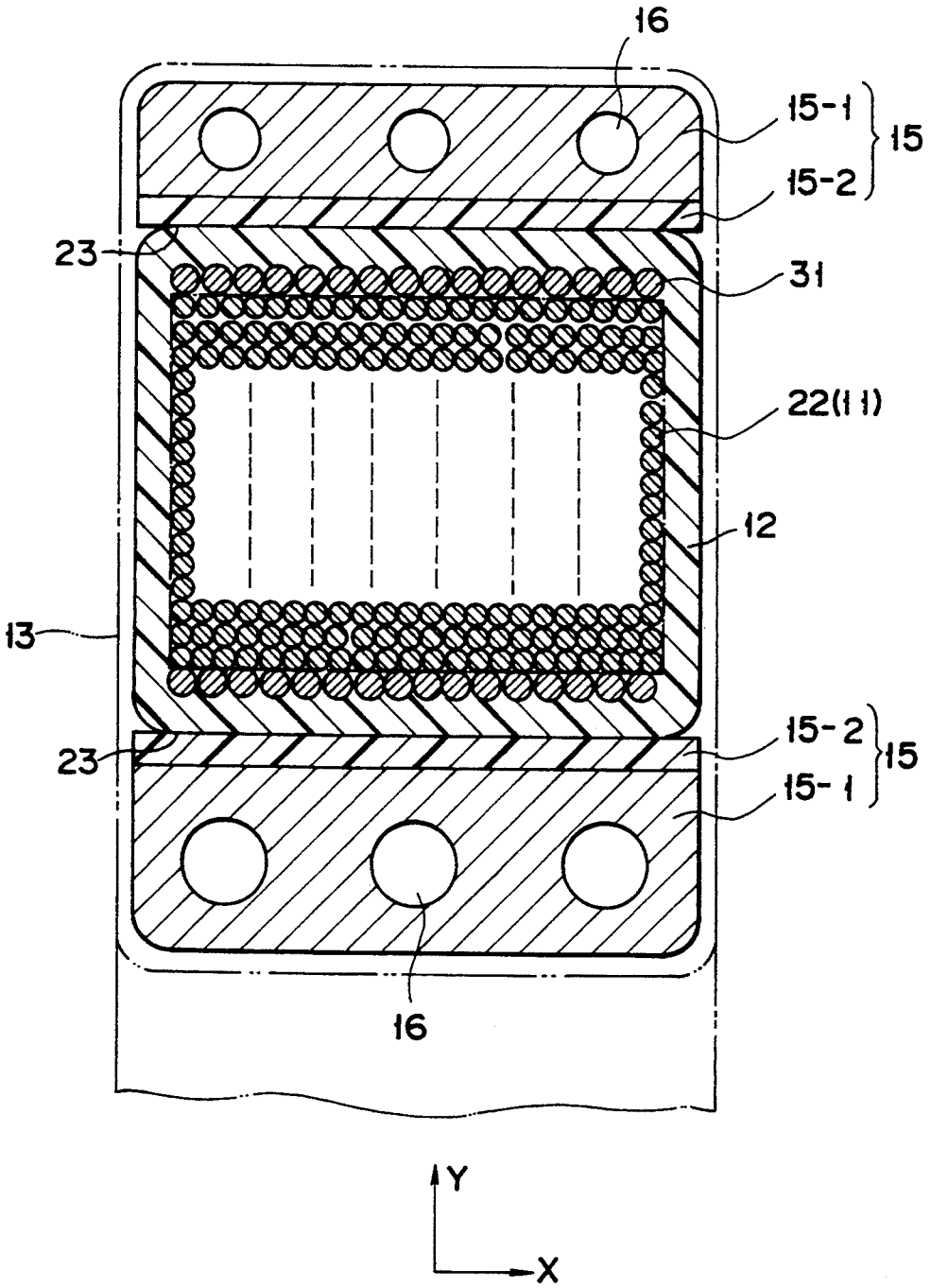
FIG. 5 is a cross-sectional view of a superconducting coil apparatus of a second embodiment of the present invention.

The second embodiment of the present invention will be explained with reference to FIG. 5.

In this embodiment, the superconducting wire of the windings 11 is the ordinary one, and good heat conducting wires 31 which are copper wires or aluminum wires, for example, extend on the radially outer and inner enveloping surfaces of the windings 11. The good heat conducting wires 31 are fixed to each other by an epoxy resin layer 12.

In this structure, the frictional heat is transmitted to the good heat conducting wires 31 in the circumferential direction of the winding unit 11 and is dissipated midway during the conduction to be prevented from being conducted into the windings 11. As a result, the superconducting wires constituting the outer and inner peripheral layers of the windings 11 become free from quenching, and thus the overall windings 11 is hindered from being quenched.

The inventors of the present invention also carried out experiments by exciting a superconducting coil apparatus according to the second embodiment of the present invention. Similarly to the first embodiment, the experimental results revealed that the quenching current for the apparatus of this embodiment was much larger than that for the conventional apparatus.

Even when plate members of a good heat conductivity are wound around and along the inner enveloping surface of the windings 11 in place of the good heat conducting wires 31, eddy currents are generated in this case. However, in this embodiment, eddy currents are rarely generated.

Figure 6:
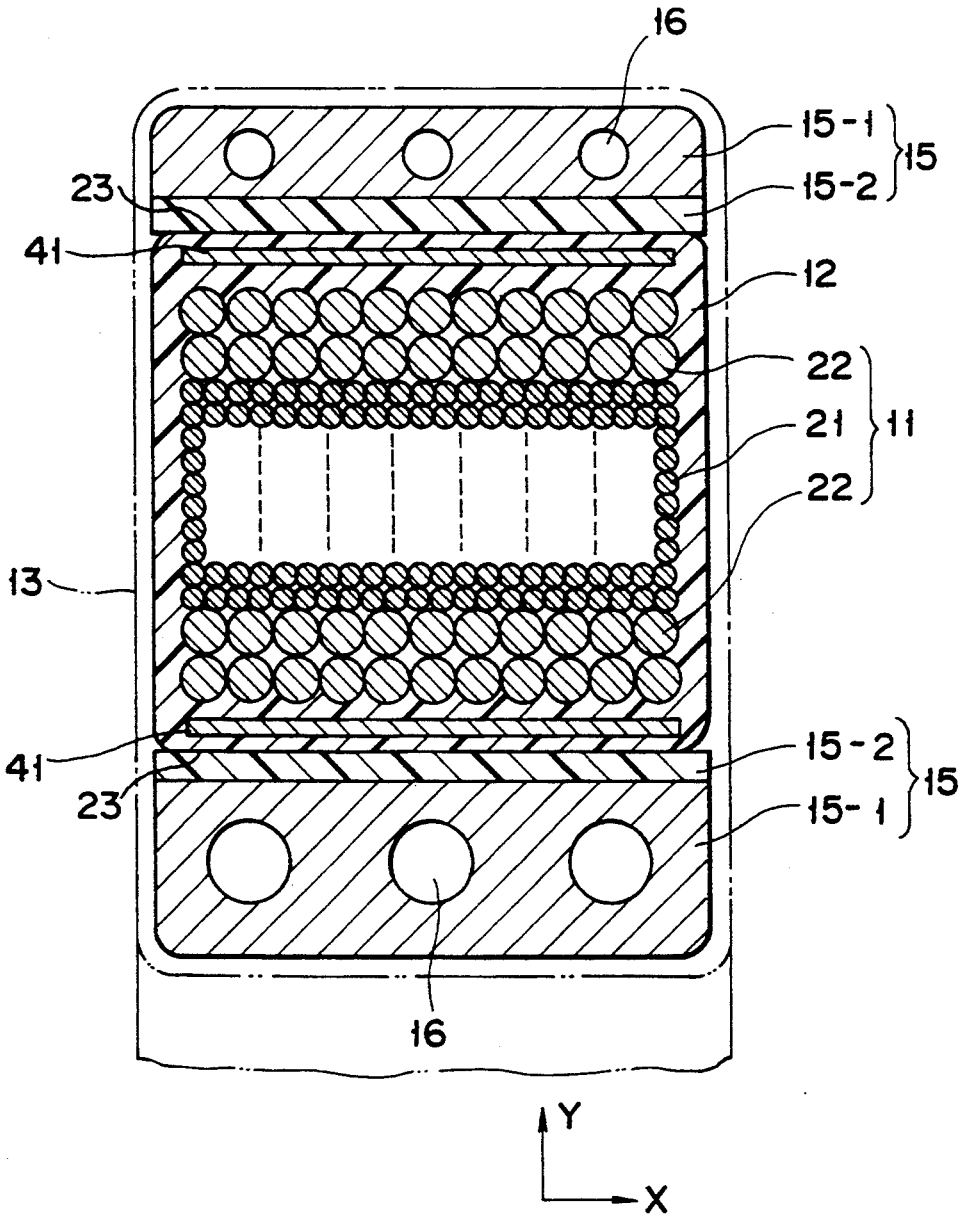
FIG. 6 is a cross-sectional view of a superconducting coil apparatus of a third embodiment of the present invention.

The third embodiment of the present invention will be explained with reference to FIG. 6.

The windings 11 of this embodiment have the same structure as the windings of the first embodiment. In the cured resin layer 12 are embedded stainless steel members 41 having a high specific heat.

Frictional heat generated at the boundary 23 is prevented from being conducted in the windings 11 by the stainless steel members 41. As a result, no quenching occurs to the superconducting wires in the outermost and innermost layers of the windings 11, and, in turn, the overall windings 11 are free from quenching. Further, since the two layers of the outer peripheral area and the two layers of the inner peripheral area of the windings 11 are formed by highly superconducting wires 22, the superconducting wires at the outermost and innermost layers of the windings 11 are more prevented from being quenched.

Figure 7:
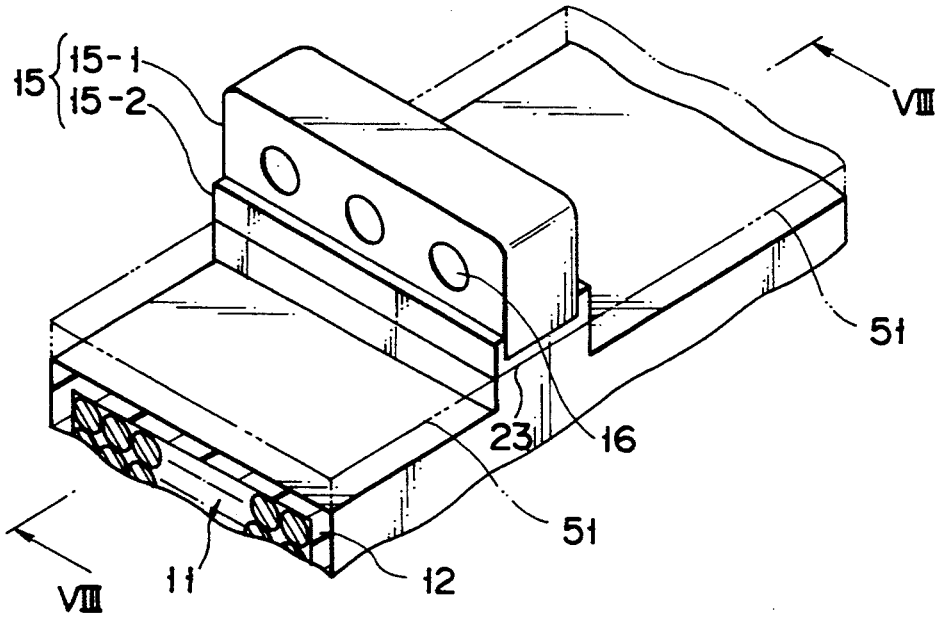
FIG. 7 is an enlarged perspective view of part of a superconducting coil apparatus of a fourth embodiment of the present invention.
Figure 8:
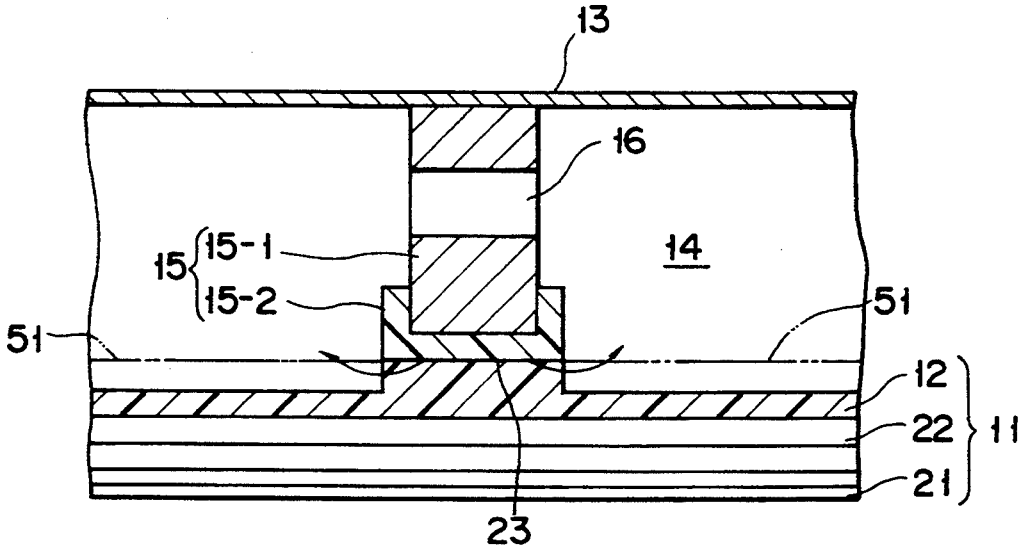
FIG. 8 is a cross-sectional view along line VIII—VIII of FIG. 7.

The fourth embodiment will be explained with reference to FIGS. 7 and 8.

In this embodiment, the portions 51 of the cured resin layer 12 of the winding unit 11 which are not in contact with the fixtures 15 (the portions indicated by the imaginary lines) are recessed or removed. As shown by the arrow in FIG. 8, the frictional heat is transmitted to the liquid helium more easily than to the windings 11. Similarly to the preceding embodiments, therefore, the superconducting wires constituting the outermost and innermost layers of the windings are prevented from being quenched, and in turn no quenching takes place in the overall winding 11.

Figure 9:
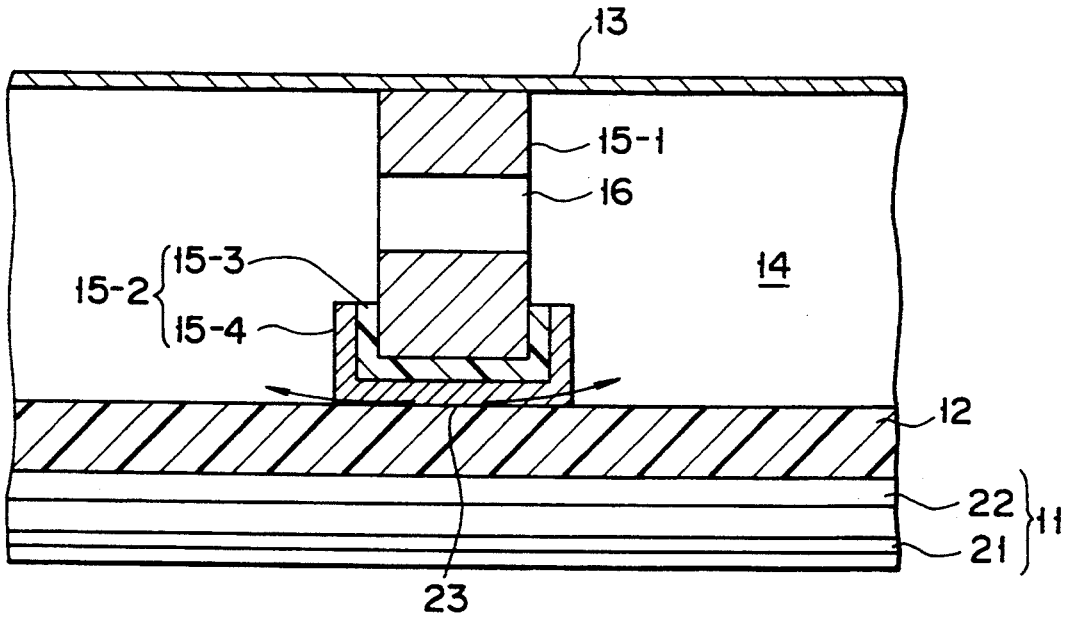
FIG. 9 is a cross-sectional view of part of a superconducting apparatus of a fifth embodiment of the present invention.

The fifth embodiment of the present invention will be explained with reference to FIG. 9.

The second portion 15-2 of each fixture comprises an FRP layer 15-3 and a good heat conducting layer 15-4 made of copper, aluminum or the like. As shown by the arrow in FIG. 9, the frictional heat is more easily transmitted to the liquid helium through the good heat conducting layers 15-4 than to the windings 11. Similarly to the preceding embodiments, the superconducting wires in the outermost and innermost layers of the windings 11 is avoided from being quenched. This allows the overall windings unit 11 to be free from quenching.

Figure 10:
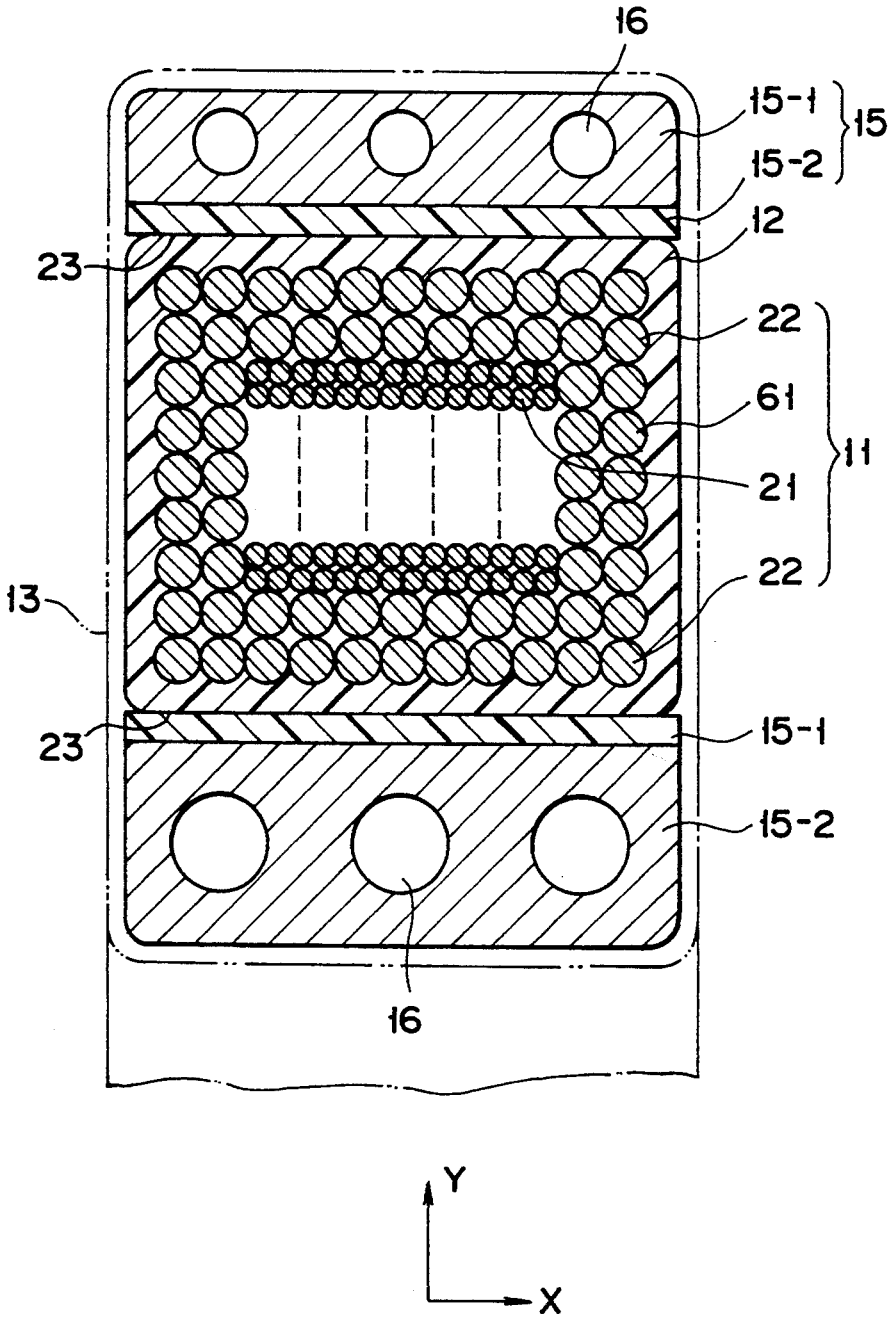
FIG. 10 is a cross-sectional view of a superconducting coil apparatus of a sixth embodiment of the present invention.

The sixth embodiment of the present invention will be explained with reference to FIG. 10.

In this embodiment, the two layers at each of the axial end sides of the windings 22 are formed by highly stabilized superconducting wires 61.

When it happens that heat is conducted to the axial end sides of the windings 11 through the outer wall of the cryostat 13, the highly stabilized conducting wires 61 have very few chance to be quenched whereby the overall windings 11 are not likely to be quenched. In this respect, the superconducting coil apparatus is excited in a stable state.

Additional advantages and modifications will readily occur to those skilled in the art. Therefore, the invention in its broader aspects is not limited to the specific details, representative devices, shown and described herein. Accordingly, various modifications may be made without departing from the spirit or scope of the general inventive concept as defined by the appended claims and their equivalents.

What is claimed is:

1. A superconducting coil apparatus comprising:

windings having superconducting wires each wound in a plurality of turns;

means for fixing said superconducting wires together;

a cryostat for housing said windings and cooling said windings in a superconducting state;

means for attaching said windings to said cryostat at predetermined positions; and means, provided at locations associated with the predetermined positions, for preventing the superconducting wires of the windings from quenching due to a conduction of a frictional heat generated at the predetermined positions into said windings, wherein said fixing means includes curable resin which is filled in spaces between the adjacent superconducting wires and firmly connects said adjacent superconducting wires together after said resin has been cured, and which is applied on said windings so as to cover the same and forms a cured resin layer around said windings after said resin has been cured;

said cryostat includes a wall separated at a predetermined space from said cured resin layer; and said attaching means includes a plurality of fixtures disposed between said cured resin layer and the said wall of said cryostat and arranged at predetermined circumferential intervals of said windings.

2. A superconducting coil apparatus according to claim 1, wherein said quenching preventing means includes a highly stabilized superconducting wire which is part of said superconducting wires of said windings and disposed in an outer peripheral area of said windings.

3. A superconducting coil apparatus according to claim 1, wherein said quenching preventing means includes a highly stabilized superconducting wire which is part of said superconducting wires of said windings and disposed in an inner peripheral area of said windings.

4. A superconducting coil apparatus according to claim 1, wherein said quenching preventing means includes a good heat conductor disposed at a outer peripheral area of said windings.

5. A superconducting coil apparatus according to claim 4, wherein said good heat conductor is a wire.

6. A superconducting coil apparatus according to claim 1, wherein said quenching preventing means includes a good heat conductor disposed at a inner peripheral of said windings.

7. A superconducting coil apparatus according to claim 6, wherein said good heat conductor is a wire.

8. A superconducting coil apparatus according to claim 1, wherein said quenching preventing means includes a member embedded in said cured resin layer and made of material having a high specific heat.

9. A superconducting coil apparatus according to claim 1, wherein said quenching preventing means includes recessed portions of said windings which are adjacent to portions thereof which are in contact with said fixtures.

10. A superconducting coil apparatus according to claim 1, wherein each of said fixtures includes a good heat conducting layer which is in contact with said cured resin layer.

11. A superconducting coil apparatus according to claim 1, wherein said quenching preventing means includes a highly superconducting wire which is part of said superconducting wires of said windings unit and disposed at axial end sides of said windings.

12. A superconducting coil apparatus comprising:

windings having superconducting wires each wound in a plurality of turns;

means for fixing said superconducting wires together;

a cryostat for housing said windings and cooling said windings in a superconducting state;

means for attaching said windings to said cryostat at predetermined positions; and means, provided at locations associated with the predetermined positions, for preventing the superconducting wires of the windings from quenching due to a conduction of a frictional heat generated at the predetermined positions into said windings, wherein said fixing means includes curable resin which is filled in spaces between the adjacent superconducting wires and firmly connects said adjacent superconducting wires together after said resin has been cured, and which is applied on said windings so as to cover the same and forms a cured resin layer around said windings after said resin has been cured;

said attaching means including a plurality of fixtures disposed at predetermined positions.

* * * * *